US007158087B2

(12) United States Patent
Dai et al.

(10) Patent No.: US 7,158,087 B2
(45) Date of Patent: Jan. 2, 2007

(54) DUAL-BAND DIPOLE ANTENNA

(75) Inventors: Hsin Kuo Dai, Tu-Chen (TW); Yun Long Ke, Tu-chen (TW); Lung-Sheng Tai, Tu-Chen (TW); Mu Hsiung Lin, Tu-chen (TW); Chin Pao Kuo, Santa Clara, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 70 days.

(21) Appl. No.: 11/025,814

(22) Filed: Dec. 28, 2004

(65) Prior Publication Data

US 2005/0212713 A1 Sep. 29, 2005

(30) Foreign Application Priority Data

Mar. 26, 2004 (TW) ..... 93108258 A

(51) Int. Cl.
*H01Q 9/16* (2006.01)

(52) U.S. Cl. ..... 343/792; 343/791

(58) Field of Classification Search ..... 343/791, 343/792, 790
See application file for complete search history.

(56) References Cited

U.S. PATENT DOCUMENTS 4,410,893 A * 10/1983 Griffee ..... 343/792
5,248,988 A * 9/1993 Makino ..... 343/792
5,604,506 A * 2/1997 Rodal ..... 343/791
6,421,024 B1 7/2002 Stolle
6,552,692 B1 * 4/2003 Zeilinger et al. ..... 343/792

* cited by examiner

*Primary Examiner*—Tho Phan
(74) *Attorney, Agent, or Firm*—Wei Te Chung

(57) ABSTRACT

A dual-band antenna (1) includes a first antenna (2) and a second antenna (3). The first antenna includes a first dipole half (11) and a second dipole half (12). The first dipole half is disposed above the second dipole half with a space therebetween and the two dipole halves are corresponding to each other in a lengthwise direction. The second antenna includes a coaxial cable (4) including an inner conductor feeding the first antenna and comprising an exposed extending section (40) acting as a radiating portion of the second antenna, and a ground patch (5) electrically connected with the second dipole half.

17 Claims, 6 Drawing Sheets

DUAL-BAND DIPOLE ANTENNA

BACKGROUND OF THE INVENTION

1. Field of the Invention

The present invention relates generally to an antenna, and more particularly to a dual-band dipole antenna.

2. Description of the Prior Art

In recent years, Wireless Local Area Network (WLAN) products under IEEE 802.11a/b/g standards, such as WLAN cards for computers are gaining popularity in wireless communication market. Wherein, IEEE 802.11b/g standard is suitable for working at 2.4–2.5 GHz frequency band, while IEEE 802.11a standard is suitable for working at 5–6 GHz frequency band. Many of said WLAN products want to be use under both IEEE 802.11a and IEEE 802.11b/g standard benefit from dual-band antennas.

For achieving dual-band effect, a dual-band dipole antenna is one of the most mature dual-band antennas in both design and manufacture.

A conventional dual-band dipole antenna is disclosed in U.S. Pat. No. 6,421,024 B1. Referring to FIG. 1, said conventional dual-band dipole antenna comprises a first antenna having two lower dipole halves 60 and 61, and a second antenna having two higher dipole halves 70 and 71. Each of the dipole halves 60, 61, 70 and 71 is formed from an electrically conductive cylindrical tube. Wherein, the lower dipole halves 60 and 61 are jointly operated at a lower frequency band range, while the higher dipole halves 70 and 71 are jointly operated at a higher frequency band range. However, the four dipole halves of the conventional dual-band dipole antenna are all made of metal material, which results in higher cost.

Hence, in this art, a dual-band dipole antenna with low cost to overcome the above-mentioned disadvantages of the prior art will be described in detail in the following embodiments.

BRIEF SUMMARY OF THE INVENTION

A primary object, therefore, of the present invention is to provide a dual-band dipole antenna with low cost for operating in wireless communications under IEEE 802.11a/b/g standard.

In order to implement the above object and overcomes the above-identified deficiencies in the prior art, a dual-band antenna of the present invention comprises a first antenna and a second antenna. The first antenna comprises a U-shaped first dipole half and an inverted U-shaped second dipole half which are disposed corresponding to each other a lengthwise direction with a space therebetween. The second antenna comprises a coaxial cable and a ground patch electrically connecting with the second dipole half. The coaxial cable has an inner conductor feeding the first antenna and comprising an exposed extending section acting as a radiating portion of the second antenna. The second dipole half and the ground patch corporately form a grounding portion of the dual-band dipole antenna.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to preferred embodiments of the present invention.

Figure 1:
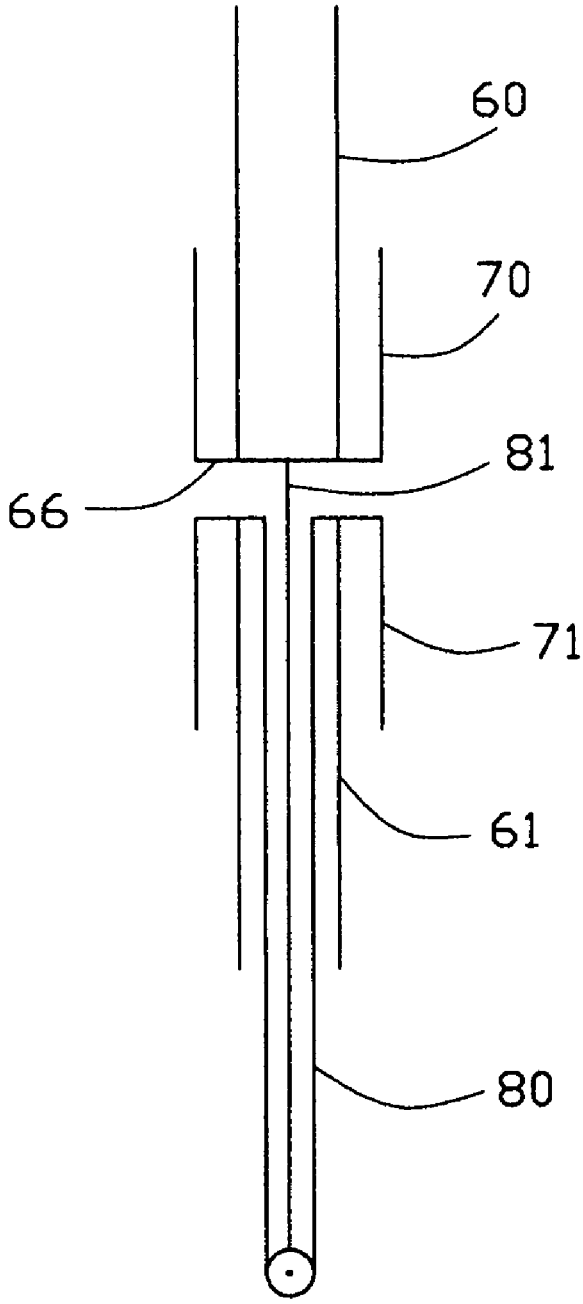
FIG. 1 (PRIOR ART)
FIG. 1 shows a conventional dual-band dipole antenna.
Figure 2:
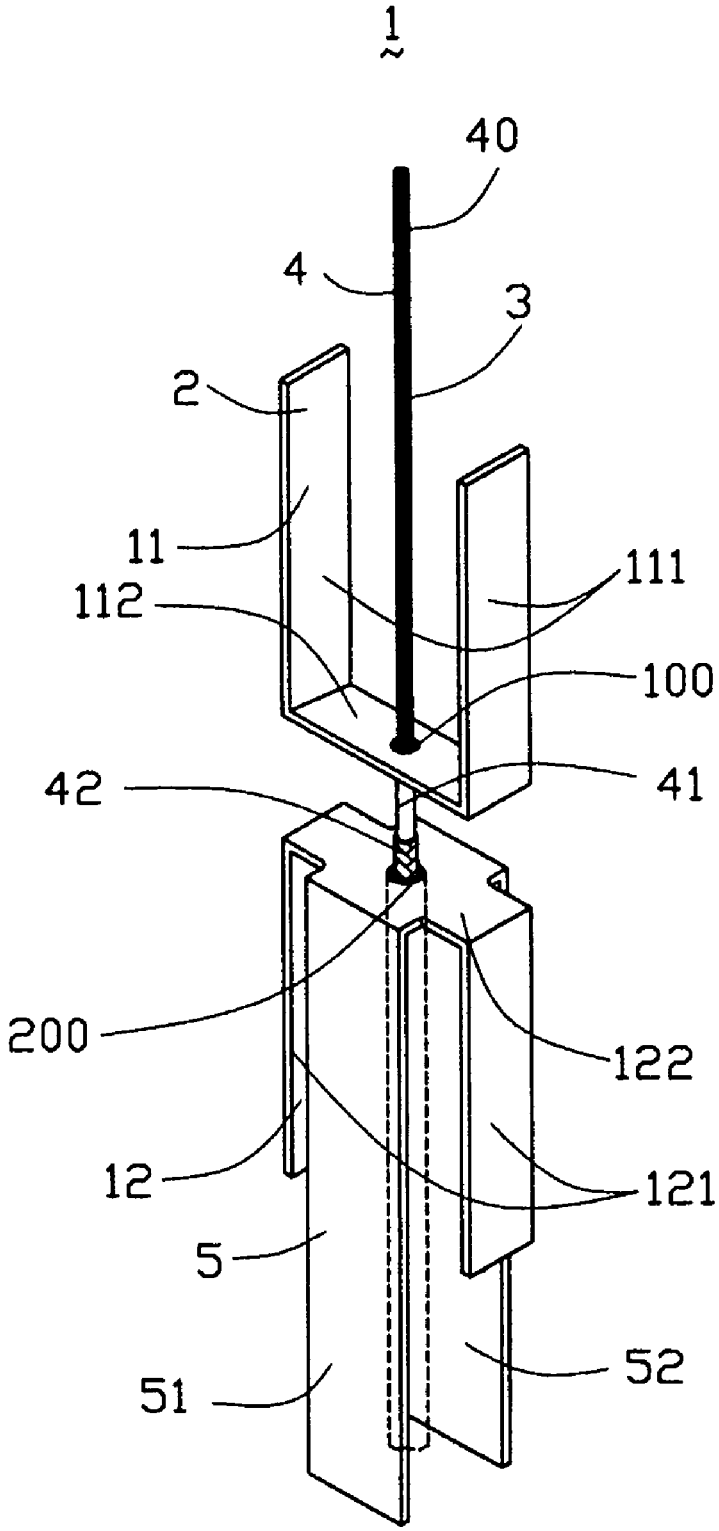
FIG. 2 is a perspective view of a dual-band dipole antenna according to a preferred embodiment of the present invention.

Referring to FIG. 2, a dual-band dipole antenna 1 according to the present invention comprises a first antenna 2 and a second antenna 3.

The first antenna 2 comprises a first dipole half 11 and a second dipole half 12, which are both made of rectangular metal plates. The first dipole half 11 is U-shaped and having a first horizontal portion 112 and two first vertical portions 111. The first horizontal portion 112 lays in a lateral direction. The two vertical portions 111 are parallel and have the same size, and respectively extend upwardly in a lengthwise direction perpendicular to said lateral direction from opposite ends of the first horizontal portion 112. The second dipole half 12 is inverted U-shaped and having a second horizontal portion 122 and two second vertical portions 121. The second horizontal portion 122 is parallel to the first horizontal portion 112. The second vertical portions 121 are parallel to one another and have the same size, and respectively extend downwardly in said lengthwise direction from two opposite ends of the second horizontal portion 122. The first and the second dipole halves 11 and 12 are arranged corresponding to each other in the lengthwise direction with a space therebetween. The first horizontal portion 112 defines a first hole 100 in the central region thereof. The second horizontal portion 122 defines a second hole 200 in the central region thereof.

The second antenna 3 comprises a coaxial cable 4 and a ground patch 5. The ground patch 5 is made of metal sheet and comprises a first patch 51 and a second patch 52 respectively extending downwardly depending from other opposite ends of the second horizontal portion 122. The first patch 51 and the second patch 52 are parallel to one another and of the same size. The first and the second patches 51 and 52 are perpendicular to and longer than the second vertical portions 121. In this preferred embodiment, the ground patch 5 and the second dipole half 12 are made of single piece of metal and formed a cross shape.

The coaxial cable 4 successively comprises an inner conductor (not labeled), an inner insulator 41, an outer conductor 42 and an outer insulator (not labeled). The coaxial cable 4 is disposed in the lengthwise direction drilling through the first hole 100 and the second hole 200. The outer conductor 42 and the inner insulator 41 are peeled off and revealed between the first and the second holes 100 and 200. The outer conductor 42 is welded on the second horizontal portion 122, and is electrically connected with the second dipole half 12 and the ground patch 5. The inner conductor is welded on the first horizontal portion 112 and is electrically connected with the first dipole half 11. The inner conductor upwardly extends from the first hole 100 to form an exposed extending section 40 located between the first vertical portions 111. The length of the extending section 40 is about a quarter of the operating wavelength of the second antenna 3. The coaxial cable 4 feeds the first antenna 2. The conjoint of the coaxial cable 4 and the first dipole half 11 is a feeder point. The first dipole half 11, the second dipole half 12 and the ground patch 5 are all axial symmetries with respect to the coaxial cable 4.

Holistically regarding the dual-band dipole antenna 1 of the present invention, the first dipole half 11 is the first radiating portion of the dual-band dipole antenna 1 and is operated at a higher frequency band, for example, 5.15–5.875 GHz. The extending section 40 of the inner conductor is the second radiating portion of the dual-band dipole antenna 1 and is operated at a lower frequency band, for example, 2.4–2.5 GHz. The second dipole half 12 and the ground patch 5 together serve as a grounding portion of the dual-band dipole antenna 1.

Figure 3:
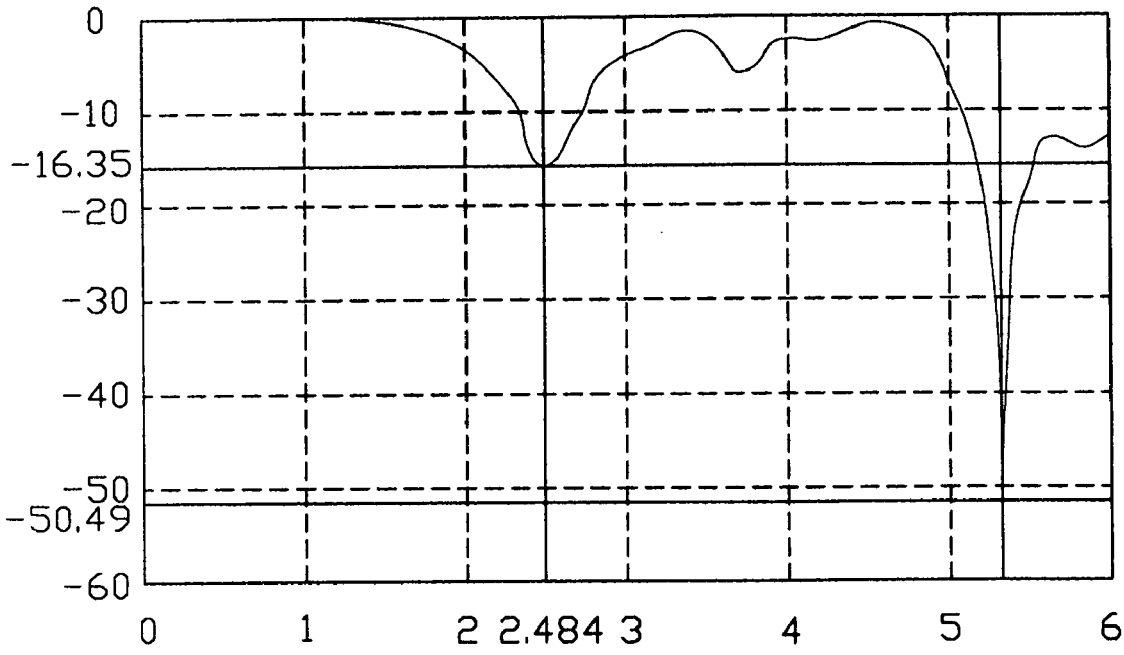
FIG. 3 is a test chart recording to Return Loss of the dual-band dipole antenna of the preferred embodiment as a function of frequency.

In order to illustrate the effectiveness according to the preferred embodiment of the present invention, FIG. 3 sets forth a test chart recording of Return Loss of the dual-band dipole antenna 1 as a function of frequency. Note that in both 2.4 GHz–2.5 GHz and 5.15 GHz–6 GHz, the Return Loss drops below the desirable minimum value "10", which conforms to the practical use conditions of an antenna in wireless communications under IEEE 802.11a/b/g standard.

Figure 4:
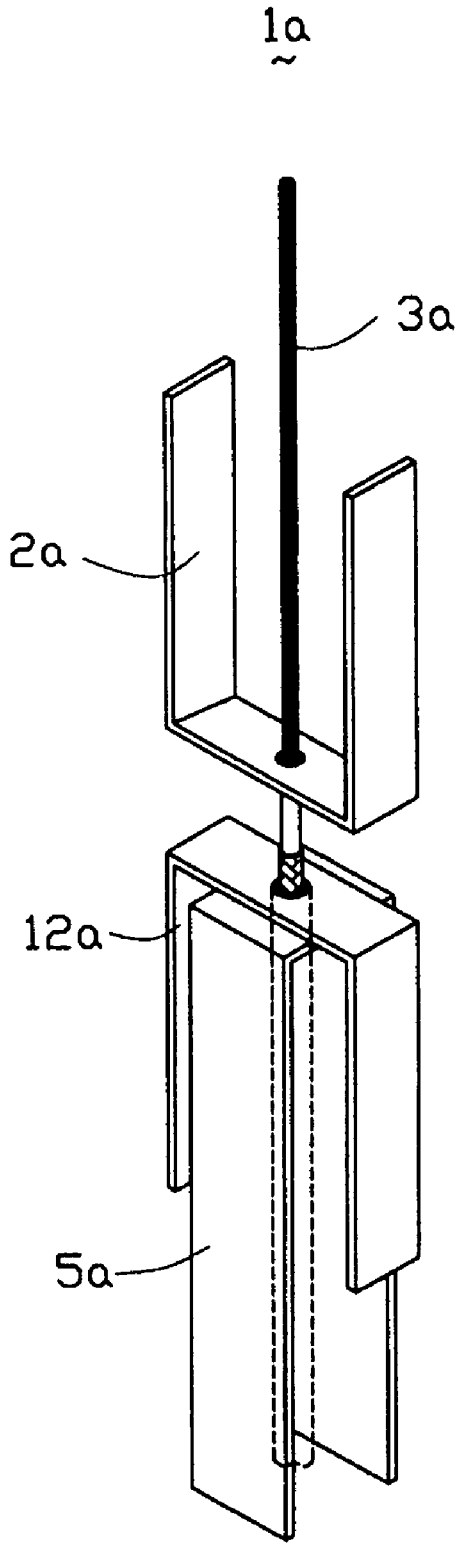
FIG. 4 is a perspective view of a dual-band dipole antenna according to a second embodiment of the present invention.

Referring to FIG. 4, a dual-band dipole antenna 1*a* according to a second embodiment comprises a first antenna 2*a* and a second antenna 3*a*. The antenna 1*a* has the same elements and structure as the dual-band dipole antenna 1 according to the preferred embodiment except that a ground patch 5*a* and a second dipole half 12*a* are separately formed of two different metal sheets and are arranged layer upon layer.

Figure 5:
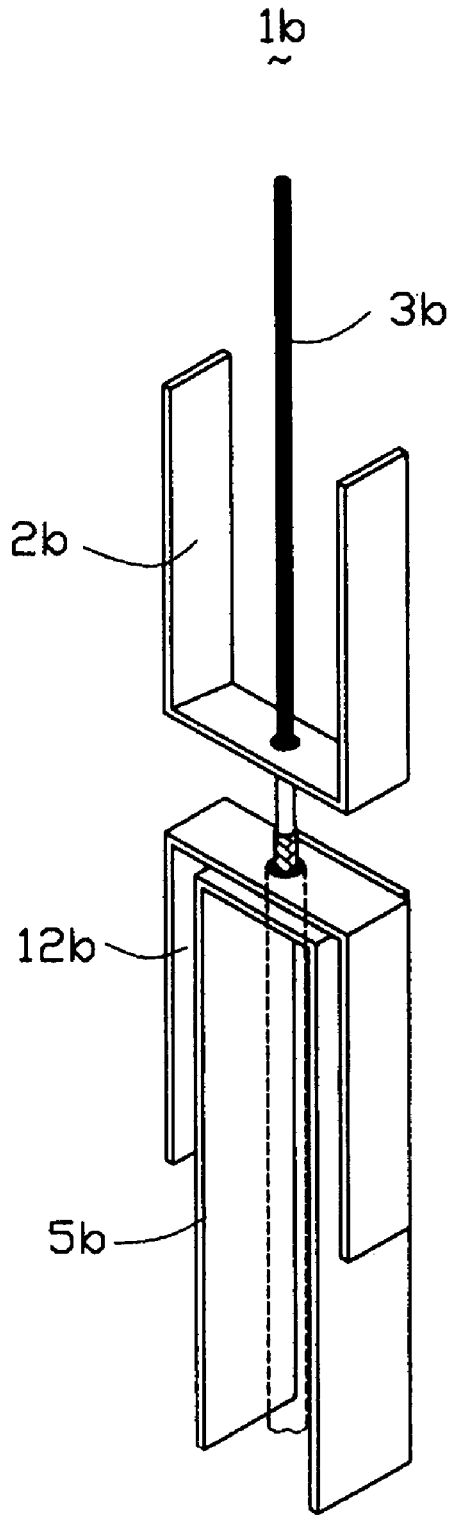
FIG. 5 is a perspective view of a dual-band dipole antenna according to a third embodiment of the present invention.

Referring to FIG. 5, a dual-band dipole antenna 1*b* according to a third embodiment comprises a first antenna 2*b* and a second antenna 3*b*. The first antenna 2*b* comprises a first dipole half (not labeled) and a n-shaped second dipole half 12*b* having two second vertical portions 121*b*. The second antenna 3*b* comprises a ground patch 5*b*. The ground patch 5*b* is n-shaped facing to the same direction as the second dipole half 12*b*. Two patches 51*b* and 52*b* of the ground patch 5*b* are arranged between and parallel to the second vertical portions 121*b*. Other configurations and connections of the antenna 1*b* can refer to the preferred embodiment or the second embodiment.

Figure 6:
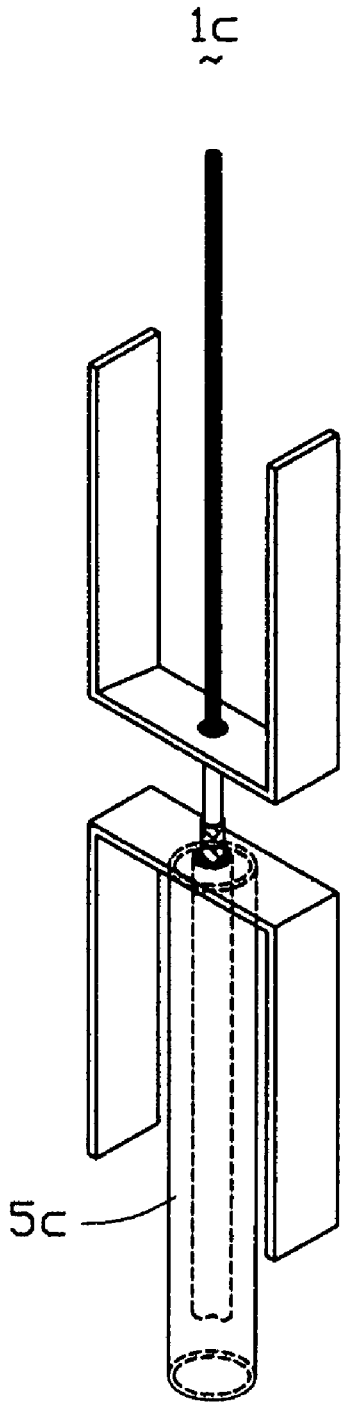
FIG. 6 is a perspective view of a dual-band dipole antenna according to a fourth embodiment of the present invention.

In other embodiments, ground patch can be formed of other shapes, for example, cylindrical shape as shown in FIG. 6 or box shape, and so on.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A dual-band dipole antenna, comprising:

a first radiating portion defining a feeder point thereon;

a grounding portion electrically insulating with the first radiating portion; and a coaxial cable comprising an inner conductor electrically connected to said feeder point and an outer conductor electrically connected to said grounding portion, the inner conductor comprising an extending section projecting from the feeder point to act as a second radiating portion.

2. The dual-band dipole antenna as claimed in claim 1, wherein the coaxial cable is arranged in a longitudinal direction and drills through the first radiating portion.

3. The dual-band dipole antenna as claimed in claim 2, wherein the grounding portion comprises a dipole half having the same size as and corresponding to the first radiating portion in the longitudinal direction.

4. The dual-band dipole antenna as claimed in claim 1, wherein the dual-band antenna comprises a sub-antenna firmed by the inner conductor and the grounding portion.

5. The dual-band dipole antenna as claimed in claim 4, wherein the length of the extending section is about a quarter of the operating wavelength of the sub-antenna.

6. The dual-band dipole antenna as claimed in claim 1, wherein the first radiating portion comprises a horizontal portion and at least two vertical portions extending from the horizontal portion.

7. The dual-band dipole antenna as claimed in claim 6, wherein the feeder point is arranged on the horizontal portion and the coaxial cable is arranged between the two vertical portions.

8. The dual-band dipole antenna as claimed in claim 1, wherein the first radiating portion is made of rectangular metal sheet and the grounding portion are made of cross-shape metal sheet.

9. A dual-band dipole antenna, comprising:

a first antenna comprising a first dipole half and a second dipole half disposed corresponding to each other in a lengthwise direction with a space therebetween; and a second antenna, comprising a coaxial cable comprising an inner conductor which feeds the first antenna and acts as a radiating portion of the second antenna, and a ground patch electrically connected wit the second dipole half.

10. The dual-band dipole antenna as claimed in claim 9, wherein the first dipole half and the second dipole half are both axially symmetric with respect to the coaxial cable.

11. The dual-band dipole antenna as claimed in claim 9, wherein the ground patch is axially symmetric with respect to the coaxial cable.

12. The dual-band dipole antenna as claimed in claim 9, wherein the first and the second dipole halves are both made of metal plates and respectively bent to form a substantial U-shape and a substantial inverted U-shape.

13. The dual-band dipole antenna as claimed in claim 9, wherein the inner conductor has an extending section projecting a length of about a quarter of the operating wavelength of the second antenna from a conjoint of the coaxial cable and the first dipole half.

14. A dual-band dipole antenna, comprising:

a first antenna comprising a first dipole structure for radiating and a second dipole structure for grounding disposed corresponding to each other in a lengthwise direction with a space therebetween, said first dipole structure and said second dipole structure being regarded to be essentially commonly lying on a first imaginary plane; and a second antenna comprising at least a third dipole structure for grounding and radiating structure, said third dipole structure and said radiating structure being regarded to be essentially commonly lying on a second imaginary plane; wherein a first imaginary plane end said second imaginary plane are at least overlapped with one line extending along said lengthwise direction, and wherein said radiating structure is an inner conductor of a coaxial cable.

15. The dual-band dipole antenna as claimed in claim 14, wherein said first plane and said second plane are intersected with each other along said line.

16. The dual-band dipole antenna as claimed in claim 14, wherein said first, second and third dipole structures is symmetrically arranged with regard to the intersection line.

17. The dual-band dipole antenna as claimed in claim 14, wherein said first dipole structure and said third dipole structure are electrically and mechanically connected with each other.

* * * * *